US007984844B2

(12) United States Patent
Jones

(10) Patent No.: US 7,984,844 B2
(45) Date of Patent: Jul. 26, 2011

(54) CARTON WITH SPOUT

(75) Inventor: Edward W. Jones, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 90 days.

(21) Appl. No.: 12/500,325

(22) Filed: Jul. 9, 2009

(65) Prior Publication Data

US 2010/0006635 A1 Jan. 14, 2010

Related U.S. Application Data

(60) Provisional application No. 61/080,080, filed on Jul. 11, 2008.

(51) Int. Cl.
*B65D 5/74* (2006.01)

(52) U.S. Cl. ..... 229/219; 229/217

(58) Field of Classification Search ..... 229/215, 229/217, 219, 221, 229
See application file for complete search history.

(56) References Cited

U.S. PATENT DOCUMENTS

| | | | | |
|---|---|---|---|---|
| 1,772,625 | A | 8/1930 | Caulfield | |
| 1,837,750 | A * | 12/1931 | Becker | 229/219 |
| 1,842,237 | A | 1/1932 | Becker | |
| 1,973,960 | A | 9/1934 | McLaughlin | |
| 2,010,863 | A * | 8/1935 | Johnson | 229/217 |
| 2,192,722 | A | 3/1940 | Vogt | |
| 2,355,665 | A | 8/1944 | Mabee | |
| 2,361,984 | A | 11/1944 | Williamson | |
| 2,475,677 | A | 7/1949 | Ringler | |
| 2,509,289 | A | 5/1950 | Dunning | |
| 2,634,897 | A | 4/1953 | Bord | |
| 2,683,953 | A | 7/1954 | Hopkins | |
| 2,701,678 | A * | 2/1955 | Read | 229/217 |
| 2,738,916 | A | 3/1956 | Peters | |
| 2,778,557 | A | 1/1957 | Moore | |
| 2,820,585 | A | 1/1958 | Nerenberg et al. | |
| 2,989,224 | A | 6/1961 | Umanoff | |
| 3,085,733 | A | 4/1963 | Umanoff | |
| 3,127,082 | A | 3/1964 | Meyer-Jagenberg | |
| 3,133,688 | A | 5/1964 | Asman | |
| 3,347,446 | A | 10/1967 | Guyer et al. | |
| 3,355,089 | A | 11/1967 | Champlin | |
| 3,363,822 | A | 1/1968 | Maulini et al. | |
| 3,426,955 | A | 2/1969 | Olson | |
| 3,580,483 | A | 5/1971 | Young | |
| 3,587,944 | A | 6/1971 | Pehr | |

(Continued)

FOREIGN PATENT DOCUMENTS

CH 412 695 A 4/1966

(Continued)

OTHER PUBLICATIONS

PCT/US2008/086591 International Search Report and Written Opinion.

(Continued)

*Primary Examiner* — Gary E Elkins
(74) *Attorney, Agent, or Firm* — Womble Carlye Sandridge & Rice, PLLC

(57) ABSTRACT

A carton for holding a dispensable material. The carton has a dispenser panel including a spout for dispensing the material. An outer spout panel overlaps the spout in the dispenser panel and is at least partially detachable from the dispenser panel to facilitate opening the spout.

21 Claims, 7 Drawing Sheets

U.S. PATENT DOCUMENTS 3,605,578 A 9/1971 Sternau
3,669,345 A 6/1972 Cote
3,680,766 A 8/1972 Collura et al.
3,690,544 A 9/1972 Meyers
3,764,058 A 10/1973 Forbes, Jr.
3,768,719 A 10/1973 Johnson
4,094,456 A 6/1978 Raccaforte
4,138,016 A 2/1979 Roccaforte
4,141,485 A 2/1979 Lambert
4,150,778 A 4/1979 Engdahl, Jr.
4,168,003 A * 9/1979 Wysocki ..... 229/217
4,194,677 A * 3/1980 Wysocki ..... 229/215
4,201,329 A 5/1980 Roccaforte
4,344,537 A 8/1982 Austin
4,361,270 A 11/1982 Roccaforte
4,411,365 A 10/1983 Horikawa et al.
4,484,683 A 11/1984 Werner, Jr.
4,508,218 A 4/1985 Focke et al.
4,558,785 A 12/1985 Gordon
4,565,315 A 1/1986 Wagner et al.
4,609,142 A 9/1986 Adamek
4,645,108 A 2/1987 Gavin et al.
4,676,394 A 6/1987 Hiersteiner
4,782,788 A 11/1988 Arcand
4,905,898 A 3/1990 Wade
4,953,781 A 9/1990 Bryan
5,014,888 A 5/1991 Bryan
5,031,825 A 7/1991 Romagnoli
5,056,708 A 10/1991 Boyle et al.
5,078,273 A 1/1992 Kuchenbecker
5,107,120 A 4/1992 Tom
5,110,042 A 5/1992 Hurden
5,141,150 A 8/1992 Plaessman
5,147,272 A 9/1992 Richison et al.
5,147,480 A 9/1992 Lang
5,166,681 A 11/1992 Bottesch et al.
5,215,250 A 6/1993 Roccaforte
5,251,808 A 10/1993 Rudd
5,259,552 A 11/1993 Kuchenberger
5,292,058 A 3/1994 Zoss et al.
5,347,865 A 9/1994 Mulry et al.
5,372,301 A * 12/1994 Besson ..... 229/215
5,429,297 A 7/1995 Walsh
5,445,316 A 8/1995 Roccaforte
5,463,384 A 10/1995 Juds
5,632,402 A 5/1997 Walsh
5,632,404 A 5/1997 Walsh
5,660,324 A 8/1997 Rowland
5,668,539 A 9/1997 Patchell
5,678,755 A 10/1997 Block
5,680,986 A 10/1997 Botterman
5,746,871 A 5/1998 Walsh
5,783,030 A 7/1998 Walsh
5,794,811 A 8/1998 Walsh
5,794,812 A 8/1998 Walsh
5,857,614 A 1/1999 Walsh
5,876,317 A 3/1999 Sigrist et al.
5,918,799 A 7/1999 Walsh
5,992,734 A 11/1999 Tokarski et al.
6,050,484 A 4/2000 Galomb
6,059,182 A * 5/2000 Wein ..... 229/219
6,062,467 A 5/2000 Ours et al.
6,102,277 A 8/2000 Krapohl, Sr.
6,109,517 A 8/2000 Cabrera
6,120,184 A 9/2000 Laurence et al.
6,145,736 A 11/2000 Ours et al.
6,152,360 A 11/2000 Block et al.
6,206,279 B1 3/2001 Countee
6,213,388 B1 4/2001 Ours et al.
6,227,440 B1 5/2001 Hart
6,328,472 B1 12/2001 Laurence et al.
6,336,584 B1 1/2002 Roch et al.
6,352,096 B1 3/2002 Walsh
6,386,438 B1 5/2002 Walsh et al.
6,419,151 B1 7/2002 Urtubey
6,424,272 B1 7/2002 Gutta et al.
6,478,216 B2 11/2002 Wiart
6,676,009 B1 1/2004 Rose
6,753,766 B2 6/2004 Patchell
6,854,639 B2 2/2005 Walsh
6,961,006 B2 11/2005 Harter, Jr. et al.
7,025,504 B2 4/2006 Olin
7,036,714 B2 5/2006 Walsh et al.
7,148,482 B2 12/2006 Harter, Jr.
7,210,612 B2 5/2007 Walsh et al.
7,253,722 B2 8/2007 Deasy et al.
2001/0048022 A1 12/2001 Zoeckler
2002/0055429 A1 5/2002 Walsh
2003/0057266 A1 3/2003 Sedo
2003/0144121 A1 7/2003 Walsh et al.
2004/0226989 A1 11/2004 Cook et al.
2005/0127150 A1 6/2005 Walsh et al.
2005/0187087 A1 8/2005 Walsh
2005/0211903 A1 9/2005 Harter
2005/0224564 A1 10/2005 Walsh
2005/0274086 A1 12/2005 Petrelli et al.
2005/0274782 A1 12/2005 Petrelli et al.
2006/0054675 A1 3/2006 Bennett
2006/0067378 A1 3/2006 Rege et al.
2006/0243783 A1 11/2006 Spivey, Sr. et al.
2006/0255106 A1 11/2006 Green
2006/0255109 A1 11/2006 Green
2006/0255113 A1 11/2006 McGowan
2007/0131752 A1* 6/2007 Jones ..... 229/215

FOREIGN PATENT DOCUMENTS

DE 29 23 455 A1 12/1980
DE 81 10 323.9 9/1981
DE 3307758 A 9/1984
DE 87 08 078.8 10/1987
DE 4308047 A1 12/1993
DE 93 20 241 5 3/1994
DE 94 13 813 U1 10/1994
EP 466337 A2 1/1992
EP 529260 A2 3/1993
EP 530643 A2 3/1993
EP 1 457 425 A1 9/2004
EP 1562053 8/2005
EP 1580542 A2 9/2005
EP 1580542 A3 1/2006
FR 2 699 150 6/1994
FR 2 755 670 5/1998
GB 104445 3/1917
GB 385 033 A 12/1932
GB 1 242 356 8/1971
GB 1 489 963 10/1977
GB 1 584 066 2/1981
GB 2 363 372 A 12/2001
WO WO 95/28325 10/1995
WO WO 99/38779 8/1999
WO WO00/74931 A1 12/2000
WO WO 02/04302 A1 1/2002
WO WO 2006/124643 A1 11/2006
WO WO 2006/133401 A2 12/2006
WO WO 2009/018400 A2 2/2009

OTHER PUBLICATIONS

PCT/US2007/015422 International Search Report and Written Opinion.

* cited by examiner

CARTON WITH SPOUT

CROSS-REFERENCE TO RELATED APPLICATIONS

This application claims the benefit of U.S. Provisional Application No. 61/080,080, filed on Jul. 11, 2008, the entire disclosure of which is incorporated herein by reference.

BACKGROUND OF THE DISCLOSURE

The present disclosure generally relates to packages or cartons for holding and dispensing dispensable material.

SUMMARY OF THE DISCLOSURE

The disclosure is directed to a carton including a spout for dispensing contents from the carton and a blank for forming such a carton. A method for dispensing contents from the carton is also disclosed.

According to an embodiment, a carton may comprise a plurality of panels including a dispenser panel defined at least partially by overlapping flaps. The overlapping flaps may include an inner flap, an intermediate flap, and an outer flap. A spout panel is defined in the outer flap and is at least partially detachable from the outer flap. An opening is formed in the intermediate flap and is substantially aligned with the spout panel. A spout is defined by the inner flap and is substantially aligned with the opening.

According to a further embodiment of a carton, the spout is attached to the spout panel such that partial detachment and movement of the spout panel away from the dispenser panel pulls the spout through the opening for dispensing contents of the carton. According to a further embodiment of a carton, the spout panel includes an actuator portion to facilitate detachment of the spout panel from the dispenser panel.

According to another embodiment, a carton blank may comprise a bottom panel, a first side panel foldably connected to the bottom panel, a second side panel foldably connected to the bottom panel, a top panel foldably connected to the first side panel or the second side panel, and a plurality of end flaps. The plurality of end flaps may comprise a first end flap foldably connected to the bottom panel and defining a first spout panel, a second end flap foldably connected to the first side panel and defining an opening, and a third end flap foldably connected to the second side panel and defining a second spout panel. The blank can be erected into a carton in which the first, second and third end flaps at least partially form a dispenser panel. In the dispenser panel, the second end flap overlaps the first end flap and the third end flap overlaps the second end flap, the second spout panel is at least partially detachable from the third end flap, and the first spout panel defines a spout substantially aligned with the opening.

According to a further embodiment of a carton blank, the second spout panel is configured to be attached to the first spout panel in the carton such that partial detachment and movement of the second spout panel away from the dispenser panel pulls the spout through the opening for dispensing contents of the carton. According to a further embodiment of a carton blank, the second spout panel comprises an actuator portion configured to facilitate detachment of the second spout panel from the dispenser panel.

According to another embodiment, a method for dispensing contents from a carton comprises providing a carton comprising: a plurality of panels including a dispenser panel defined at least partially by overlapping flaps including an inner flap, an intermediate flap, and an outer flap; a spout panel defined in the outer flap; an opening formed in the intermediate flap substantially aligned with the spout panel; and a spout defined by the inner flap substantially aligned with the opening. The method further comprises at least partially detaching the spout panel from the outer flap, moving of the spout panel away from the dispenser panel, pulling the spout through the opening, and dispensing contents of the carton through the spout.

According to a further embodiment of a method for dispensing contents from a carton, the spout is attached to the spout panel such that moving the spout panel away from the dispenser panel pulls the spout through the opening.

Other features, aspects, and embodiments will be apparent from the following description and accompanying figures.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to constructs, sleeves, cartons, or the like, and packages for holding and dispensing material such as dispensable materials that can include products such as cat litter, oatmeal, cereal, or any other dispensable material. In this specification, the terms "lower," "bottom," "upper" and "top" indicate orientations determined in relation to fully erected cartons.

Figure 1:
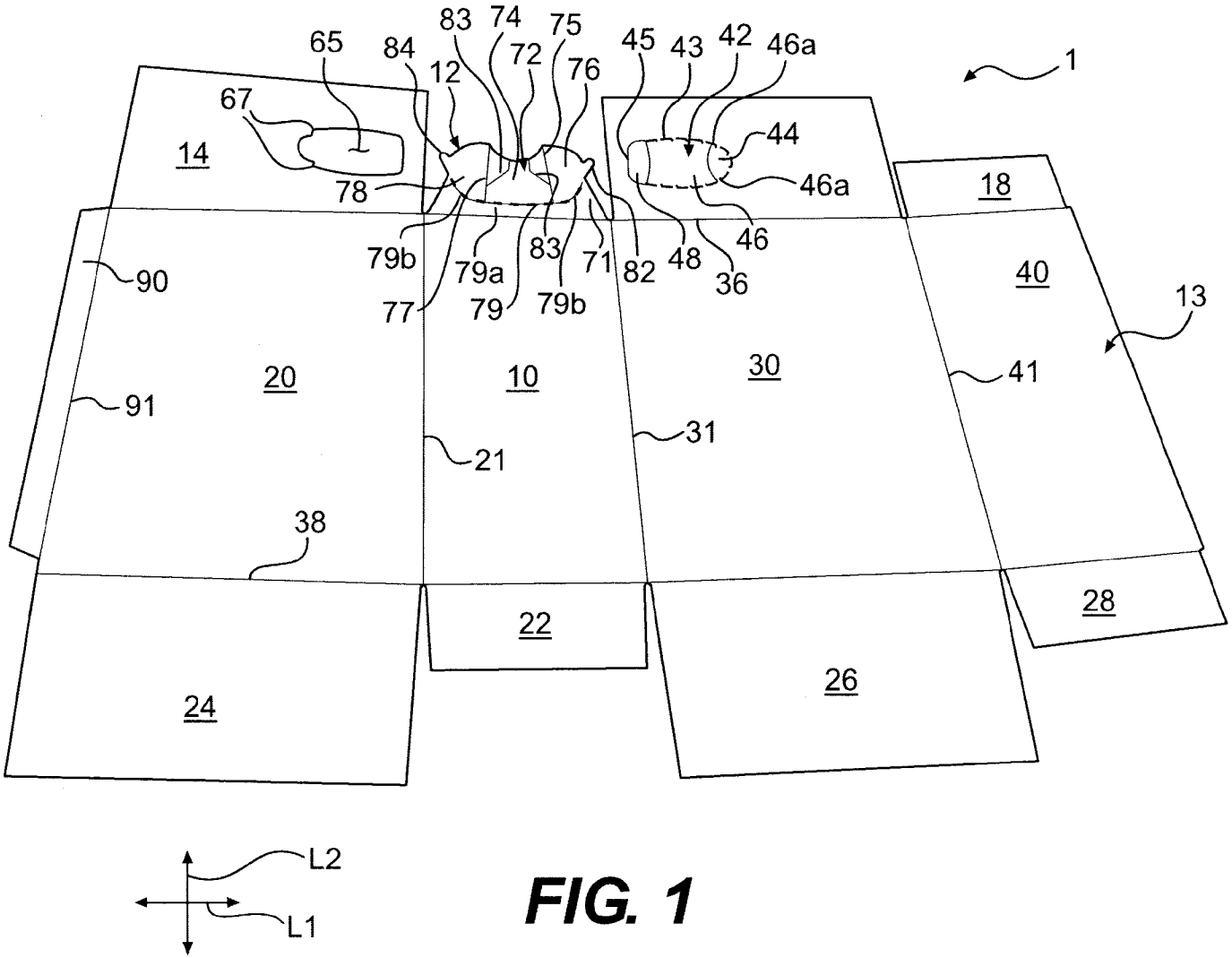
FIG. 1 is a plan view of an exterior side of a carton blank, according to an embodiment.
Figure 6:
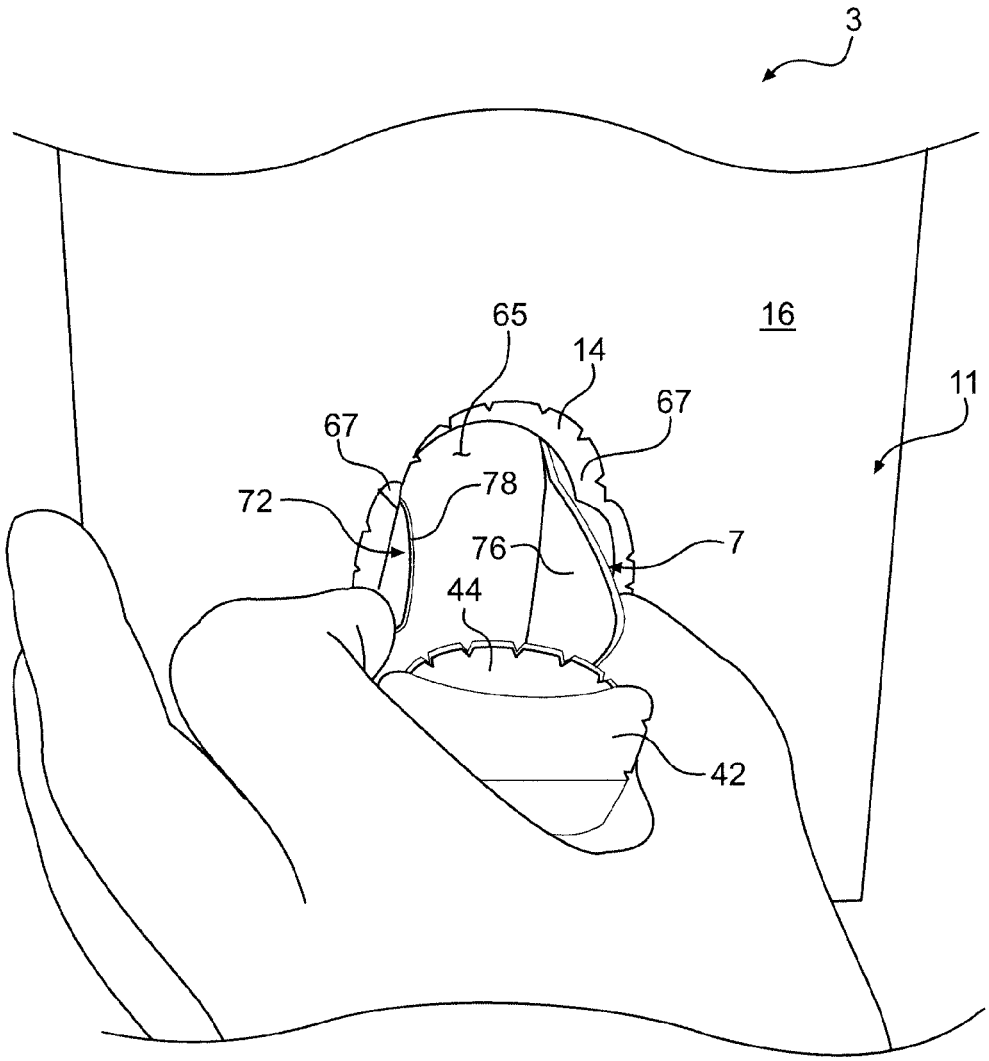
FIG. 6 illustrates a process of closing the spout.
Figure 7:
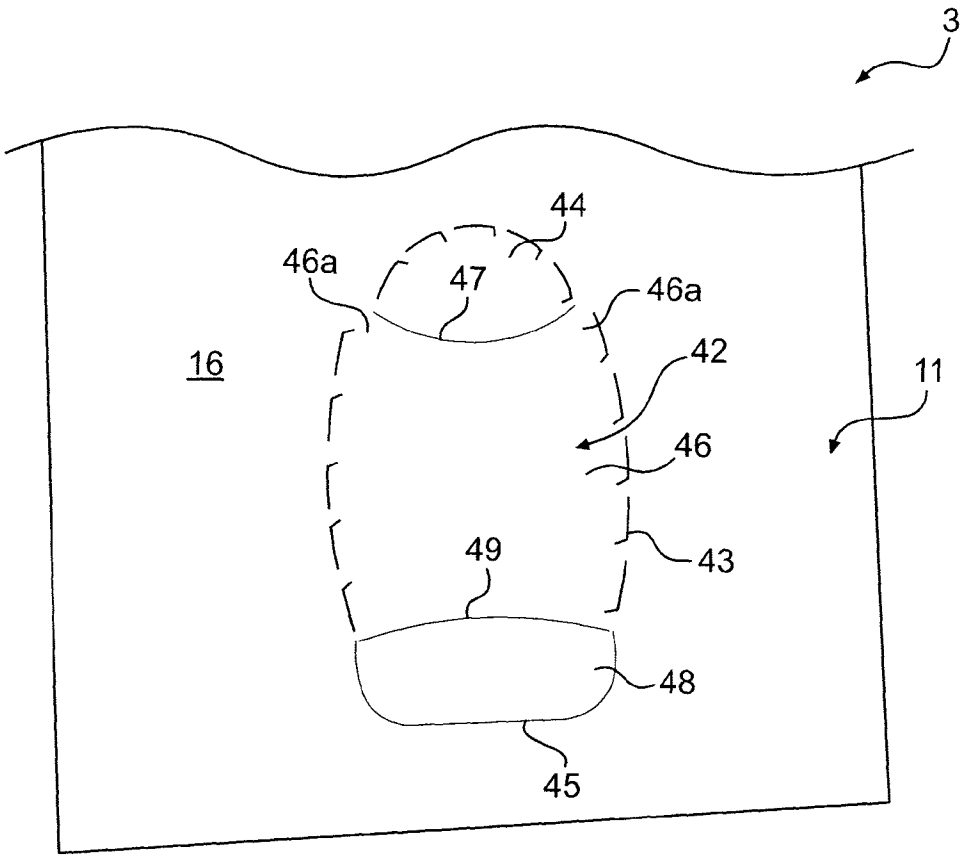
FIG. 7 shows the carton after the spout has been re-closed from the open position.

FIG. 1 illustrates a blank 1 for forming a carton 3 (FIGS. 2-7) according to one embodiment of the disclosure. The carton 3 has a spout 7 that is moveable between a closed position (FIG. 2) and an open position (FIG. 7). In the illustrated embodiment the spout 7 is formed in an end 11 of the carton 3, but the spout could be otherwise located, arranged, and positioned in the same or other panels and/or flaps of the carton without departing from the disclosure.

FIG. 1 is a plan view of an exterior side 13 of a blank 1 used to form the carton 3. The blank 1 has a longitudinal axis L1 and a lateral axis L2. The blank 1 comprises a bottom panel 10 foldably connected to a first side panel 20 at a first lateral fold line 21, a second side panel 30 foldably connected to the bottom panel 10 at a second lateral fold line 31, and a top panel 40 foldably connected to the second side panel 30 at a third lateral fold line 41.

Figure 2:
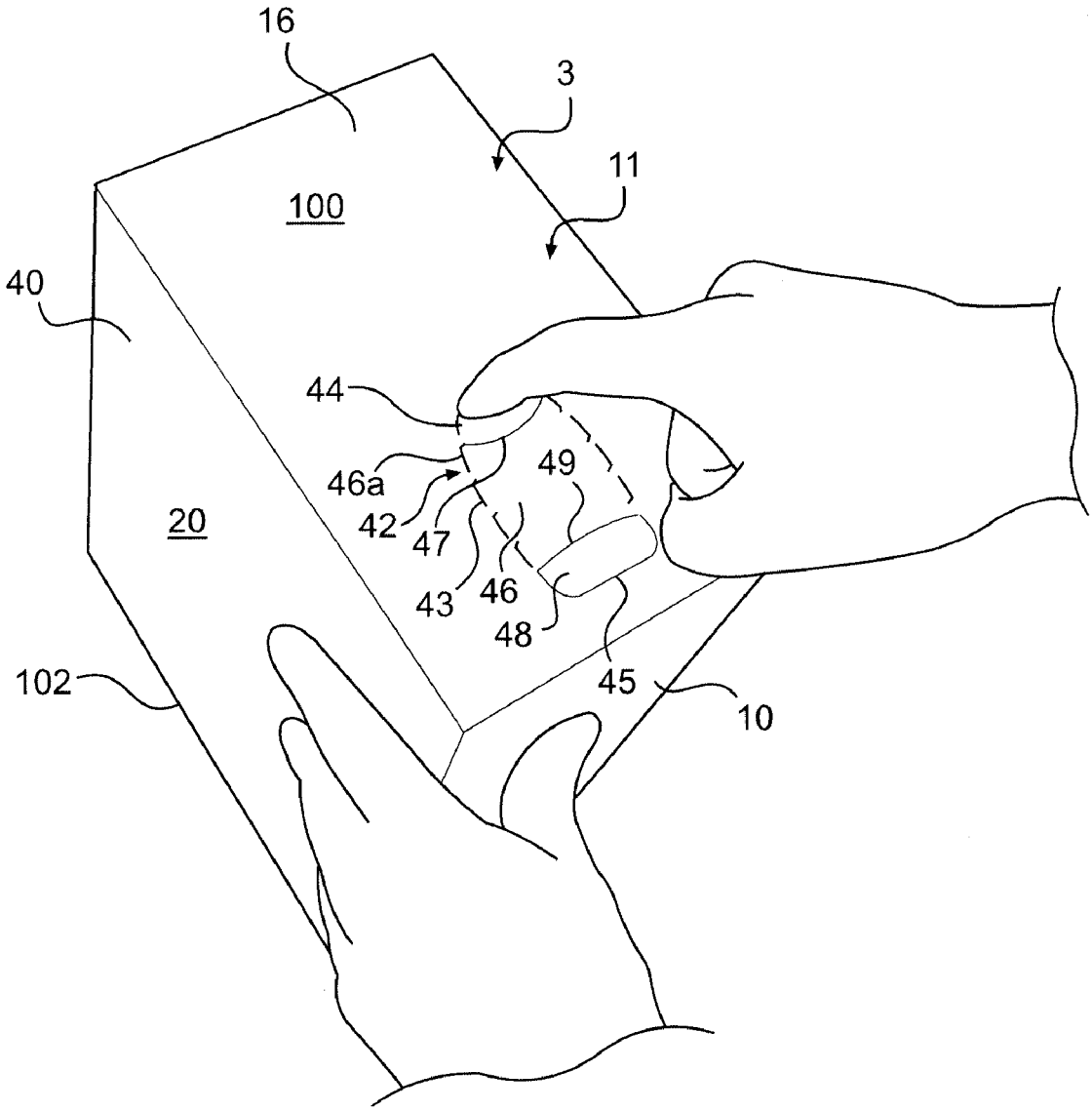
FIG. 2 is a perspective view of a carton erected from the blank of FIG. 1, wherein a spout of the carton is in a closed position.

End flaps 12, 14, 16, 18 are respectively connected to a respective panel 10, 20, 30, 40 and extend along a first marginal edge of the blank 1. End flaps 22, 24, 26, 28 are respectively connected to a respective panel 10, 20, 30, 40 and extend along a second marginal area of the blank 1. The end flaps 12, 14, 16, and 18 are connected at a first longitudinal fold line 36 and end flaps 22, 24, 26, 28 are connected at a second longitudinal fold line 38. The end flaps 12, 14, 16, 18 close a first end 11 of the carton 3 and the end flaps 22, 24, 26, 28 close a second end 35 of the carton 3 (FIG. 2).

The end flap 16 comprises an outer spout panel 42 that is at least partially defined by a tear line 43 and a fold line 45. The outer spout panel 42 includes an actuator portion 44, a central portion 46, and an anchor portion 48. The central portion includes two shoulders 46*a* adjacent to the actuator portion 44. The outer spout panel 42 includes a fold line 47 connecting the actuator portion 44 to the central portion 46 and a fold line 49 connecting the central portion 46 to the anchor portion 48. The outer spout panel 42 could be otherwise shaped, arranged, and located without departing from the disclosure.

The end flap 14 includes an opening 65 that is generally a mirror image to the outer spout panel 42. The end flap 14 includes two projections 67 that project into the opening 65. The opening 65 could be otherwise shaped, arranged, and located without departing from the disclosure.

The end flap 12 includes an inner spout panel 72 connected to a base panel 71 at a line of disruption 79 at a marginal edge of the base panel 71. The base panel 71 is foldably connected to the bottom panel 10 at the first longitudinal fold line 36. The inner spout panel 72 has a central portion 74, a first side portion 76 foldably connected to the central portion at a fold line 75. The central portion 74 is foldably connected to the base panel 71 at a central fold line segment 79*a* of the line of disruption 79. Each side portion 76, 78 is separable from the base portion 71 of the end flap 12 at outer tear line segments 79*b* of the line of disruption 79. Each side portion 76, 78 includes a respective finger 82, 84 adjacent a curved outer edge of the inner spout panel 72. The central portion 74 includes two fold lines 83. The inner spout panel 72 could be otherwise shaped and arranged without departing from the disclosure.

A closure flap 90 is foldably connected to the first side panel 20 at a fourth lateral fold line 91. The closure flap 90 attaches to the top panel 40 for closing a top 15 of the carton 3 (FIG. 2). It is noted that, although the closure panel 90 is foldably connected to the first side panel 20 and the top panel 40 is foldably connected to the second side panel 30, it is possible to switch the positions of the closure panel 90 and the first side panel 20. Specifically, in an alternate embodiment (not shown), the top panel 40 may be foldably connected to the first side panel 20 and the closure panel 90 may be foldably connected to the second side panel 30.

Referring to FIG. 2, the blank 1 can be erected into a carton 3 having the bottom panel 10, the first side panel 20, the second side panel 30, the top panel 40, a first end panel 100 at the first end 11 of the carton 3, and a second end panel 102 at the second end 35 of the carton 3. The first end panel 100 is formed by an overlapping arrangement of the end flaps 12, 14, 16, 18 and the second end panel 102 is formed by the overlapping arrangement of the end flaps 22, 24, 26, 28. The first end panel 100 forms a dispenser panel for dispensing contents from the carton 3. In the first end panel 100, the inner spout panel 72 forms a spout 7 (FIG. 5) and the outer spout panel 42 is adhered to the inner spout panel 72. The central portion 46 of the outer spout panel 42 can be adhered to the central portion 74 of the inner spout panel 72. In one embodiment, the end flap 14 is disposed between the end flaps 12, 16 with the end flap 16 being the outer end flap and the end flap 12 being the inner end flap. The attachment of the central portions 46, 74, of the outer and inner spout panels 42, 72 allows the side portions 76, 78 of the inner spout panel 72 to be free from attachment to the outer spout panel 42. Also, since the end flap 12 is located toward the interior of the end flap 14, the inner spout panel 72 is initially positioned behind the opening 65 when the spout 7 is in the closed position shown in FIG. 2.

Figure 3:
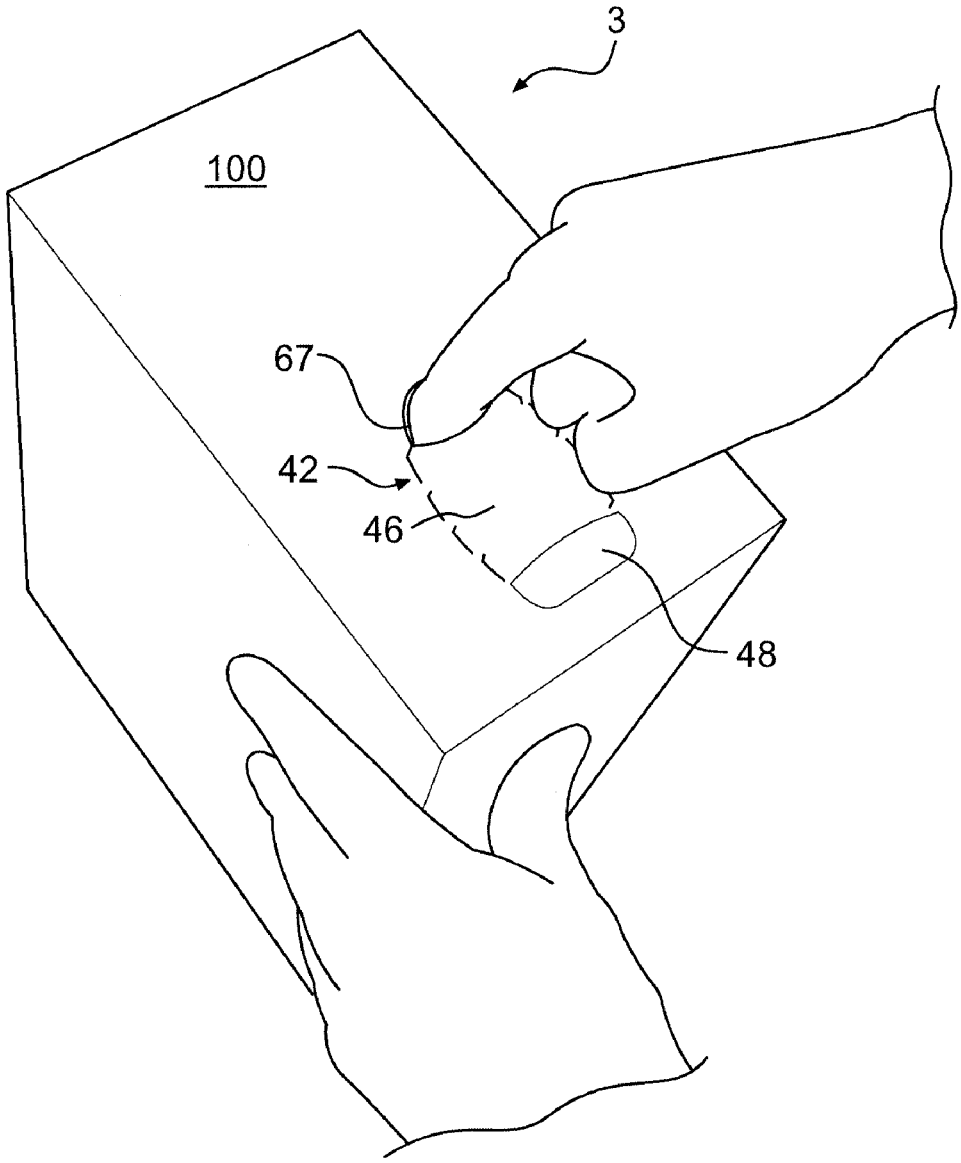
FIGS. 3 and 4 illustrate a process of opening the spout.
Figure 4:
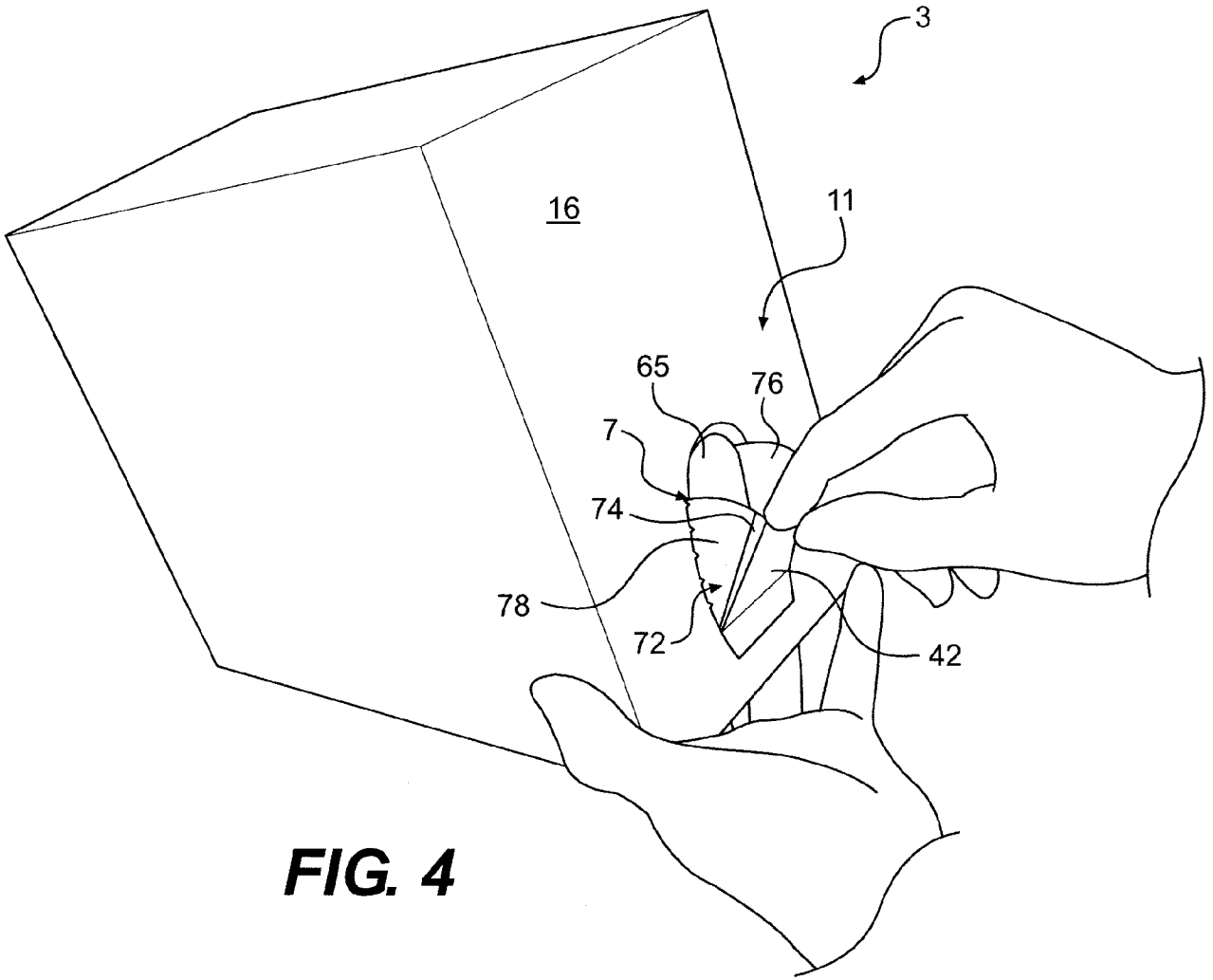
Figure 5:
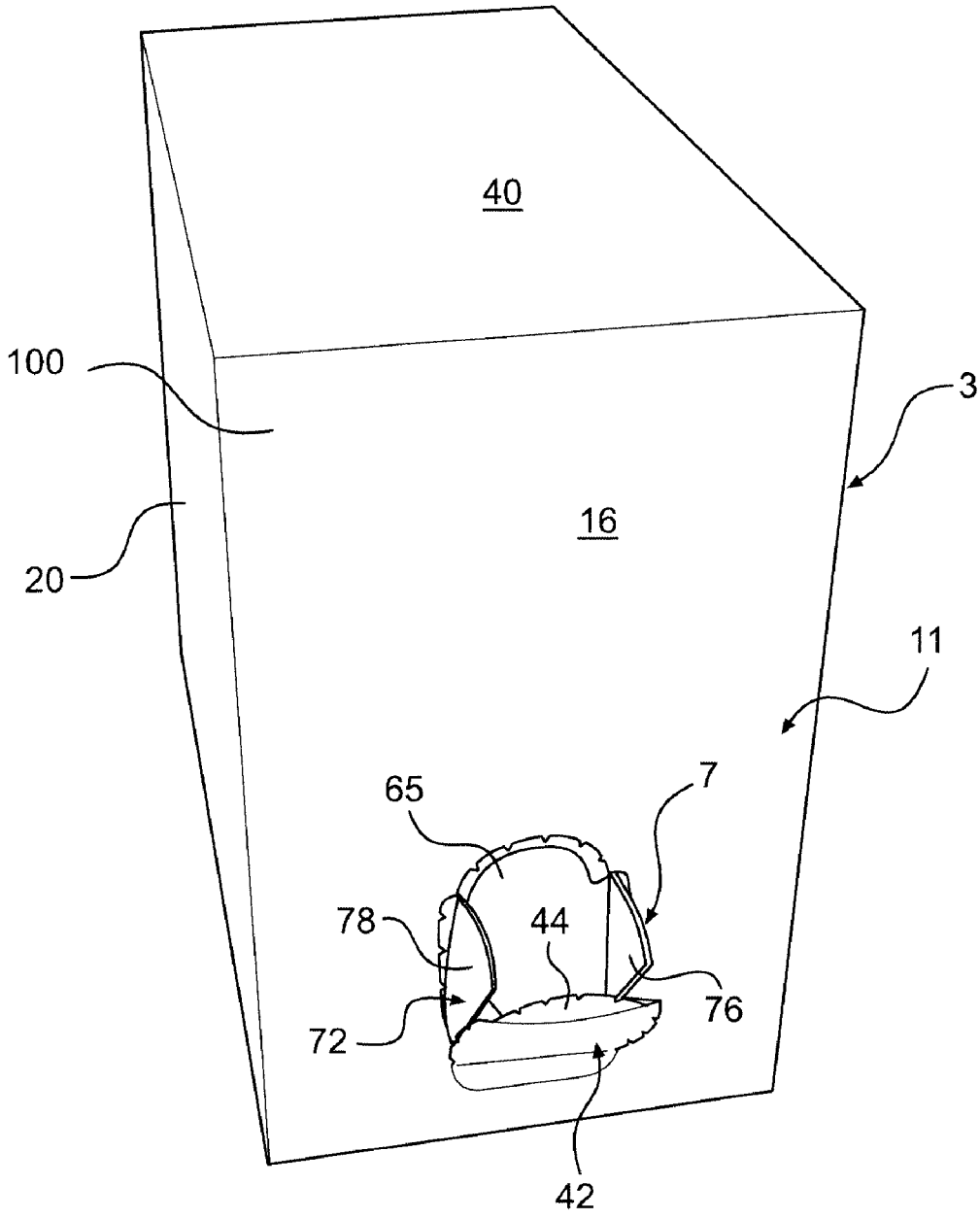
FIG. 5 shows the carton with the spout in an open position.

FIGS. 3 and 4 illustrate an exemplary process for opening the spout. To open the spout 7, the spout 7 is first activated by pressing the actuator portion 44 inwardly and separating the actuator portion 44 from the end flap 16 for grasping of an upper portion of the outer spout panel 42. The outer spout panel 42 is then pulled such that the central portion 46 is separated from the end flap 16 and pivoted outwardly from the first end panel 100. Since the central portions 46, 74 are attached to each other, pivoting the central portion 46 of the outer spout panel 42 outwardly from the first end panel 100 causes the inner spout panel 72/spout 7 to be pivoted and pulled outwardly through the opening 65 and opened into an open position, as shown in FIG. 5. Optionally, an upper edge of the inner spout panel 72/spout 7 may be grasped together with the upper portion of the outer spout panel 42 for pivoting the central portion 46 and the outer spout panel 42. When the spout 7 is opened, the side portions 76, 78 allow the adhered central portions 42, 74 of the outer and inner spout panels 42, 72 to pivot outward. The fingers 82, 84 engage the projections 67 of the end flap 14 to form a stop that limits the outward movement of the spout 7. The spout 7 can have other arrangements and mechanisms for limiting the outward movement without departing from the disclosure. After material is dispensed, the spout 7 can be closed by pushing the spout 7 in towards the interior of the carton 3, as illustrated in FIGS. 6 and 7.

The spout 7 could have alternative configurations and can be opened and closed by other steps without departing from the disclosure. Further, one or more of the panels and end flaps of the carton may be coated with a barrier material to prevent moisture transmission through the carton. Further, a liner can be used to contain the dispensable material in the carton.

In general, the blank may be constructed from paperboard having a caliper of at least about 26, for example, so that it is heavier and more rigid than ordinary paper. The blank can also be constructed of other materials, such as cardboard, or any other material having properties suitable for enabling the carton to function at least generally as described above.

The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or panels adhered together by glue. The term "glue" is intended to encompass all manner of adhesives commonly used to secure paperboard carton panels in place, and the adhesive material can be replaced by, or supplemented with any suitable fastening devices.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, cut line, or the like. For example, a cut line can be a continuous slit or could be wider than a slit without departing from the present disclosure.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the disclosure. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton comprising:

a plurality of panels including a dispenser panel;

the dispenser panel being defined at least partially by overlapping flaps including an inner flap, an intermediate flap, and an outer flap;

an outer spout panel defined in the outer flap and being at least partially detachable from the dispenser panel, the outer spout panel comprising an outer central portion, an actuator portion foldably connected to the outer central portion, and an anchor portion foldably connected to the outer central portion and the outer flap;

an opening formed in the intermediate flap substantially aligned with the outer spout panel; and an inner spout panel in the inner flap substantially aligned with the opening, the inner spout panel comprising an inner central portion, two side portions foldably connected to the inner central portion, and a finger formed in each of the side portions, wherein the inner spout panel is moveable away from the dispenser panel for dispensing contents of the carton, wherein the actuator portion is inwardly pivotable with respect to the outer central portion of the outer spout panel to facilitate at least partial detachment of the outer spout panel from the dispenser panel and movement of the inner spout panel away from the dispenser panel, and wherein the fingers limit movement of the inner spout panel away from the dispenser panel.

2. The carton of claim 1 and wherein the inner spout panel is attached to the outer spout panel such that partial detachment and movement of the outer spout panel away from the dispenser panel pulls the inner spout panel through the opening for dispensing the contents of the carton.

3. The carton of claim 1 and wherein the dispenser panel is an end panel of the carton.

4. The carton of claim 1 and wherein the actuator portion is partially defined by an arcuate tear line and is partially separable from the dispenser panel at the arcuate tear line.

5. The carton of claim 1 and wherein the outer spout panel is partially detachable from the dispenser panel and partially hingedly connected to the dispenser panel such that, upon detachment, the outer spout panel can pivot away from the dispenser panel to facilitate pulling of the inner spout through the opening.

6. The carton of claim 1 and wherein the side portions fold to form sides of the inner spout panel when the inner central portion is pulled through the opening in the intermediate flap.

7. The carton of claim 6 and further comprising projections formed in the periphery of the opening, the fingers engaging the projections to limit movement of the inner spout panel through the opening.

8. The carton of claim 1 wherein the outer spout panel is foldably connected to the outer flap at a first fold line, the anchor portion is foldably connected to the central portion at a second fold line.

9. The carton of claim 8 wherein the first fold line is spaced apart from the second fold line.

10. The carton of claim 8 wherein the first fold line defines a bottom edge of the outer spout panel.

11. The carton of claim 8 wherein the outer spout panel is at least partially defined by a tear line having a first portion extending from the anchor portion and second portion extending from the anchor portion, the second fold line extends between the first portion of the tear line and the second portion of the tear line.

12. A carton blank comprising:

a bottom panel;

a first side panel foldably connected to the bottom panel;

a second side panel foldably connected to the bottom panel;

a top panel foldably connected to the first side panel or the second side panel; and a plurality of end flaps, the plurality of end flaps comprising a first end flap foldably connected to the bottom panel and defining a first spout panel, the first spout panel comprising side portions foldably connected to a first central portion, and a finger formed in each of the side portions;

a second end flap foldably connected to the first side panel and defining an opening, and a third end flap foldably connected to the second side panel and defining a second spout panel, the second spout panel comprising a second central portion, an actuator portion foldably connected to the second central portion, and an anchor portion foldably connected to the second central portion and the third end flap;

wherein the blank is configured to be erected into a carton in which the first end flap, the second end flap and the third end flap at least partially form a dispenser panel in which the second end flap overlaps the first end flap and the third end flap overlaps the second end flap, the second spout panel is at least partially detachable from the third end flap, the first spout panel defines a spout substantially aligned with the opening, the spout is moveable away from the dispenser panel for dispensing contents of the carton, the actuator portion is inwardly pivotable with respect to the central portion to facilitate at least partial detachment of the spout panel from the dispenser panel and movement of the spout away from the dispenser panel, and the fingers limit movement of the spout away from the dispenser panel.

13. The blank of claim 12 and wherein the second spout panel is configured to be attached to the first spout panel in the carton such that partial detachment and movement of the second spout panel away from the dispenser panel pulls the spout through the opening for dispensing the contents of the carton.

14. The blank of claim 12 and wherein the actuator portion is partially defined by an arcuate tear line and is partially separable from the dispenser panel at the arcuate tear line.

15. The blank of claim 12 and wherein the second spout panel is configured to be partially detachable from the dispenser panel and partially hingedly connected to the dispenser panel such that, upon detachment, the second spout panel can pivot away from the dispenser panel to facilitate pulling of the spout through the opening.

16. The carton of claim 12 and wherein the side portions fold to form sides of the spout when the first central portion is pulled through the opening in the intermediate flap.

17. The blank of claim 16 and further comprising projections formed in the periphery of the opening, and wherein, in the carton formed from the blank, the fingers are configured to engage the projections to limit movement of the spout through the opening.

18. A method for dispensing contents from a carton, comprising:

providing a carton comprising a plurality of panels including a dispenser panel defined at least partially by overlapping flaps including an inner flap, an intermediate flap, and an outer flap;

an outer spout panel defined in the outer flap, the outer spout panel comprising an outer central portion, an actuator portion foldably connected to the outer central portion, and an anchor portion foldably connected to the outer central portion and the outer flap;

an opening formed in the intermediate flap substantially aligned with the spout panel; and an inner spout panel in the inner flap substantially aligned with the opening, the inner spout panel comprising an inner central portion, two side portions foldably connected to the inner central portion, and a finger formed in each of the side portions;

attaching the outer central portion and the inner central portion to form a spout;

pivoting the actuator portion inwardly with respect to the outer central portion;

at least partially detaching the outer spout panel from the outer flap;

moving the spout away from dispenser panel until the fingers limit movement of the spout; and dispensing contents of the carton through the spout.

19. The method of claim 18, wherein moving the spout away from the dispenser panel pulls the inner spout panel through the opening.

20. The method of claim 18, comprising partially separating the actuator portion from the dispenser panel prior to pivoting the actuator portion inwardly with respect to the outer central portion.

21. The method of claim 18, wherein the intermediate end flap comprises projections formed in the periphery of the opening, and wherein, in the carton, the fingers engage the projections to limit movement of the spout through the opening.

* * * * *